United States Patent [19]

Yamamoto et al.

[11] Patent Number: 4,976,126

[45] Date of Patent: Dec. 11, 1990

[54] SPINNING MACHINE

[75] Inventors: Takashi Yamamoto; Hiroshi Yamamoto, both of Higashiosaka, Japan

[73] Assignee: Kabushiki Kaisha Yamamoto Kinzoku Seisakusho, Osaka, Japan

[21] Appl. No.: 388,472

[22] Filed: Aug. 2, 1989

[51] Int. Cl.[5] ..... B21D 22/18

[52] U.S. Cl. ..... 72/83; 72/81

[58] Field of Search ..... 72/81, 82, 83, 85, 7

[56] References Cited

U.S. PATENT DOCUMENTS 4,380,916 4/1983 Tanaka ..... 72/7
4,509,351 4/1985 Rolin et al. ..... 72/83

FOREIGN PATENT DOCUMENTS 240337 11/1985 Japan ..... 72/83
68226 3/1988 Japan ..... 72/82
2075389 11/1981 United Kingdom ..... 72/82

*Primary Examiner*—Lowell A. Larson
*Attorney, Agent, or Firm*—Wenderoth, Lind & Ponack

[57] ABSTRACT

A spinning machine has a mold fixedly mounted on a spindle and a forming roller adapted to move in a predetermined manner so as to be pressed against the material to be formed mounted on the spinning mold. By moving the forming roller in a controlled manner, the material can be formed into a desired shape. The forming roller is mounted on a roller carriage reciprocable in one direction which is in turn supported by a transverse feed carriage reciprocable in a direction normal to the one direction. The carriages are driven by hydraulic cylinders. Two servo motors are provided to separately drive two rack gears in the above two normal directions. Two servo valves are provided, each adapted to move the respective hydraulic cylinders so that the carriages will move in synchronism with the respective rack gears. By manipulating a handle in a teaching unit, the servo motors and eventually the forming roller can be controlled in a desired manner. The driving signals thus given to the servo motors are stored in a position controller and a sequencer so that the servo motors can be automatically controlled in the next operation, based upon the signals or data stored.

5 Claims, 5 Drawing Sheets

SPINNING MACHINE

BACKGROUND OF THE INVENTION

The present invention relates to a spinning machine for forming a metallic material by use of a forming roller while the roller is being rotated.

A prior art spinning machine is shown in FIG. 10, which comprises a spindle 5, a mold 1 fixedly mounted on the spindle 5, a tailstock spindle 2 and a forming roller 6 rotatably mounted on one end of an arm 7. A disk-shaped metallic material 3 is mounted between the mold 1 and the tailstock spindle 2.

The arm 7 is reciprocably mounted on a reciprocating carriage 8 which is driven by a hydraulic cylinder 9 so as to reciprocate along a guide frame 10 in a direction perpendicular to a direction of back-and-forth movement of the arm 7.

On the guide frame 10 is fixedly mounted a gauge 11 on which is mounted another gauge 12 so as to be pivotable about a shaft 13 by means of a hydraulic cylinder 14.

On the rear end of the arm 7, there is provided a servo valve 15 having its working piece 16 in engagement with the gauges 11 and 12. The hydraulic cylinder for the arm 7 is controlled by the servo valve 15 so that the forming roller 6 can move following the contour of the gauges 11 and 12.

With this prior art machine, the hydraulic cylinders 9 and 14 are controlled with an electrical program so that the pivotable gauge 12 will pivot in the direction of the arrow by a predetermined angle per stroke of the reciprocating carriage 8 to gradually bend the material in the initial stage toward the mold 1 as shown by chain lines, and then to press the material 3 against the mold 1.

Since the forming roller 6 is adapted to move following the contour of the gauges, it is necessary to prepare gauges 11 and 12 having different contours for a mold 1 of different shapes.

Further, since it is difficult to specify the directional properties and elongation of the metallic plate to be formed, a long time is required for the setting of the mold 1 and the gauges 11 and 12.

SUMMARY OF THE INVENTION

An object of the present invention is to provide a spinning machine which obviates the abovesaid shortcomings.

According to the present invention, since a forming roller is driven hydraulically by controlling small-sized servo motors, a large-sized material can be easily formed.

Also, once an operational sequence and a manipulated variable are stored in a sequencer and a position controller initially, a roller carriage and a transverse feed carriage can be driven thereafter according to the operational sequence and the manipulated variable thus memorized. This will eliminate the need for the gauges employed in the prior art machines. The size or shape of the products can be changed easily and simply by renewing the operational data with a new teaching operation.

In the finishing step, the oil pressure on a cylinder for longitudinal feed is automatically restricted to a predetermined level by a relief valve. This arrangement will not only prevent the formation of a gap between the mold and the material, but will also make it possible for the forming roller to respond instantly to any change in the hardness and thickness of the material.

In one of the recent spinning machines, a sequencer for longitudinal feed is employed to numerically control the movement of the forming roller with respect to the direction of a single axis only. But with such uniaxial control, it is impossible to cope with differences in hardness among the materials and changes in the temperature of the hydraulic oil. According to the present invention, the movement of the forming roller is controlled biaxially, i.e. the longitudinal and transverse directions. This arrangement will allow the forming roller to repeatedly and exactly follow the locus as instructed in the initial step, irrespective of changes in the temperature of oil, thus making it possible to precisely and repeatedly form products having the shape as instructed.

After teaching, a command to drive the forming roller at a speed twice or three times the originally set driving speed may be given to the position controller. In such a case, the rotational speed of the spindle has to be increased correspondingly. This will improve the efficiency of operation.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 1:
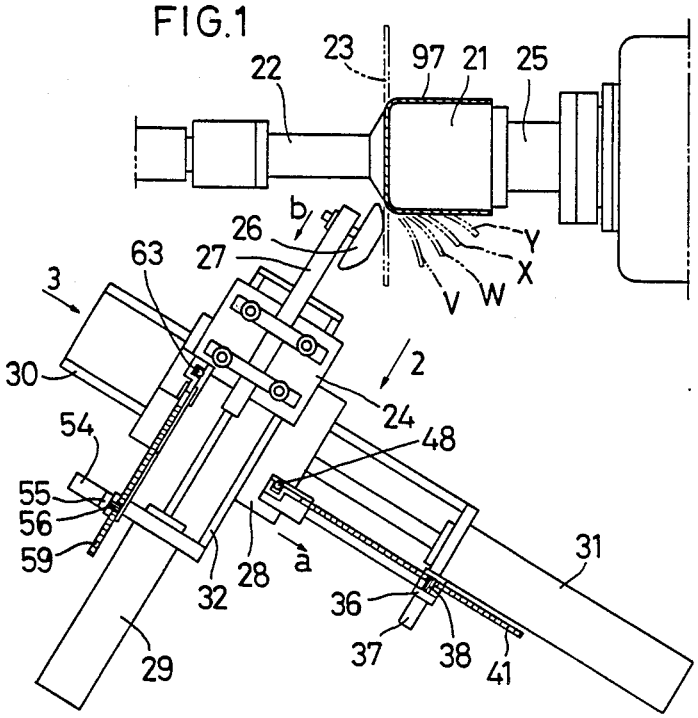
FIG. 1 is a plan view of a spinning machine embodying the present invention.

In the preferred embodiment shown in FIG. 1, numeral 21 designates a mold fixedly mounted on a spindle 25. A disk-shaped metallic material 23 is adapted to be rotated while being held between the mold 21 and a tailstock spindle 22.

A forming roller 26 is rotatably mounted on one end of an arm 27, which is fixedly mounted on a roller carriage 24 mounted on a transverse feed carriage 28. The roller carriage 24 is driven by a hydraulic cylinder 29 for longitudinal feed so as to be reciprocated along a guide frame 32 provided on the transverse feed carriage 28.

The transverse feed carriage 28 is driven by a hydraulic cylinder 31 for transverse feed so as to be reciprocated along a guide frame 30 in a direction normal to the reciprocating direction of the roller carriage 24.

Figure 4:
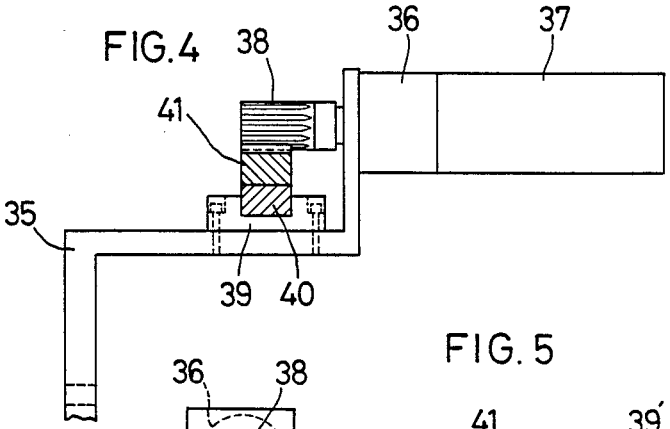
FIG. 4 is an enlarged vertical sectional side view taken along line 4—4 of FIG. 2.

As shown in FIG. 4, an angle bracket 35 is fixedly mounted on the guide frame 30. An electromagnetic clutch 36 and a servo motor 37 are mounted on top of the bracket 35 at one side thereof. A pinion gear 38 is fixedly mounted on the output shaft of the electromagnetic clutch 36.

On the horizontal portion of the bracket 35 is mounted a guide carriage 39 slidably fitted with a mobile rail 40 extending parallel to the cylinder 31. A rack gear 41 for transverse feed is mounted on the rail 40 so as to be in meshing engagement with the pinion gear 38.

For smooth operation, a linear ball bearing made by Kabushiki kaisha THK (in Tokyo) should preferably be used for the guide carriage 39 and the mobile rail 40.

Figure 2:
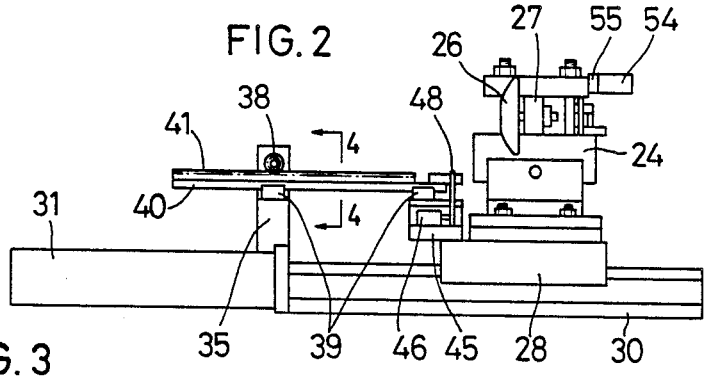
FIG. 2 is a front view the spinning machine of FIG. 1 as seen from the direction of arrow 2 of FIG. 1.
Figure 5:
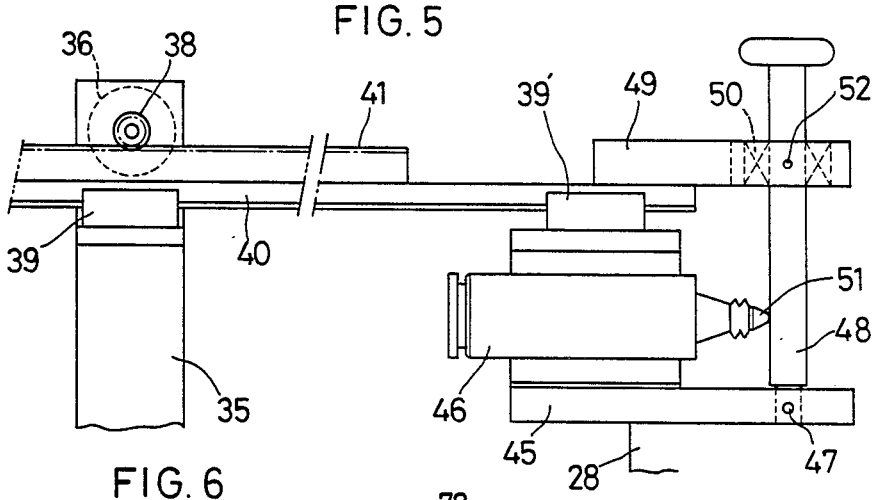
FIG. 5 is a partially cutaway enlarged front view of a driving mechanism for one of the servo motors.

In FIGS. 2 and 5, a support carriage 45 is fixedly mounted on the transverse feed carriage 28. On the support carriage 45, a servo valve 46 for transverse feed and a guide carriage 39' of the same type as the carriage 39 are fixedly mounted.

Also there is provided on the support carriage 45 a lever 48 pivotable about a shaft 47. The lever 48 has its intermediate portion slidably engaged in a slide bearing 50 pivotally mounted through a pin 52 to a coupling member 49 fixed to one end of the mobile rail 40. The servo valve 46 has a working piece 51 in contact with the lever 48 at one side thereof.

The servo valve 46 is a mechanical servo valve of a spring return type. When the working piece 51 is pushed by the lever 48 to the lefthand side of FIG. 5, a spool in the servo valve 46 will be moved to left, compressing a spring therein. When the lever 48 moves to right, the spool will be urged by the spring to right together with the working piece 51.

Figure 3:
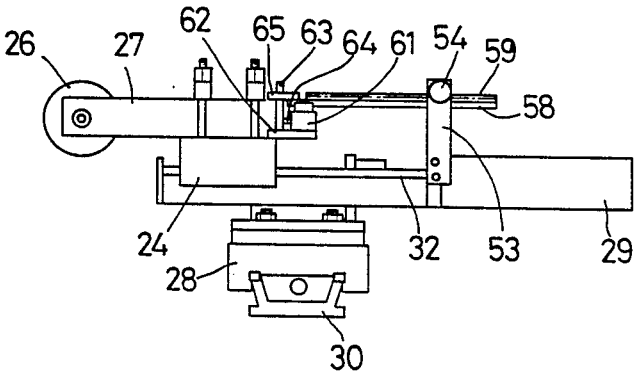
FIG. 3 is a side view of the spinning machine as seen from the direction of arrow 3 of FIG. 1.

Numeral 53 in FIG. 3 designates a bracket fixed to the guide frame 32 and having a servo motor 54 and an electromagnetic clutch 55 mounted thereon. A pinion gear 56 (FIG. 1) is fixed to the output shaft of the electromagnetic clutch 55.

Numeral 58 in FIG. 3 designates a mobile rail extending parallel to the moving direction of the roller carriage 24. The rail 58 is movably supported on the bracket 53 and the roller carriage 24 in the same manner as the mobile rail 40. A rack gear 59 for longitudinal feed is mounted on the rail 58 so as to be in meshing engagement with the pinion gear 56.

Numeral 61 in FIG. 3 designates a servo valve for longitudinal feed fixedly mounted on a support carriage 62 mounted on the roller carriage 24. A lever 63 is pivotally mounted at its bottom end on the support carriage 62. The servo valve 61 has a working piece 64 in contact with the lever 63. It is identical in construction to the servo valve 46.

The lever 63 is received in a slide bearing (not shown) mounted on a coupling member 65 secured to one end of the mobile rail 58 in the same manner as the coupling member 49 is coupled to the lever 48.

Figure 6:
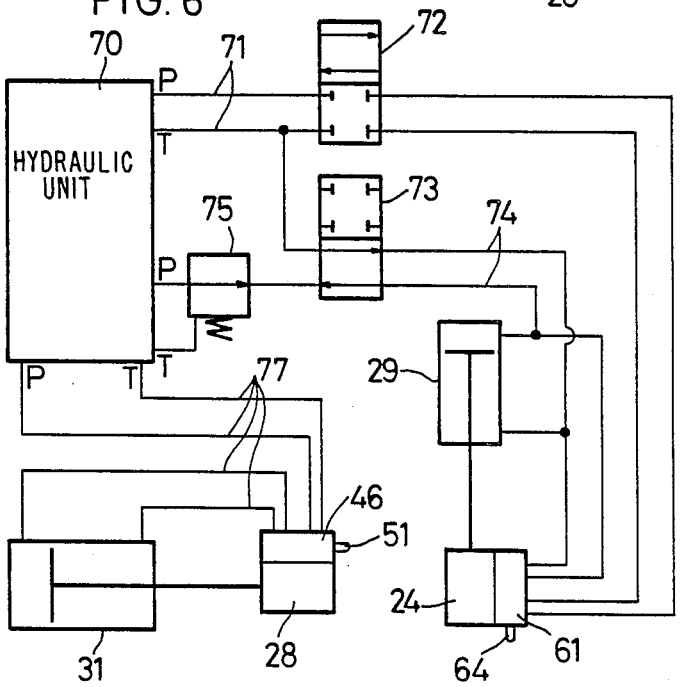
FIG. 6 is a hydraulic circuit diagram of the same.

In the hydraulic circuit diagram in FIG. 6, numeral 70 designates a hydraulic unit including a hydraulic pump, its driving motor and an oil tank. 71 indicates a hydraulic circuit for the hydraulic cylinder 29 for longitudinal feed. It leads from the hydraulic unit 70 to front and rear ports of the hydraulic cylinder 29 through the servo valve 61. In the line between the hydraulic unit 70 and the servo valve 61, there is provided a solenoid valve 72 for opening and closing the hydraulic circuit 71.

A hydraulic circuit 74 for finishing work also leads to the front and rear ports of hydraulic cylinder 29. In the circuit 74, there is provided a solenoid valve 73 for finishing work having one of its two ports in communication with the circuit 71 at the tank side and the other port in communication with a relief valve 75 leading to a pump port and a tank port of the hydraulic unit 70.

The hydraulic cylinder 31 for transverse feed has its front and rear ports in communication with a tank port and a pump port through another hydraulic circuit 77 in which is provided the servo valve 46.

The servo motors 37 and 54 should be pulse motors comprising an actuator and a driver and provided with pulse encoders 43 and 44, respectively, so that they can rotate in response to pulse signals and produce pulse signals while in rotation.

Figure 7:
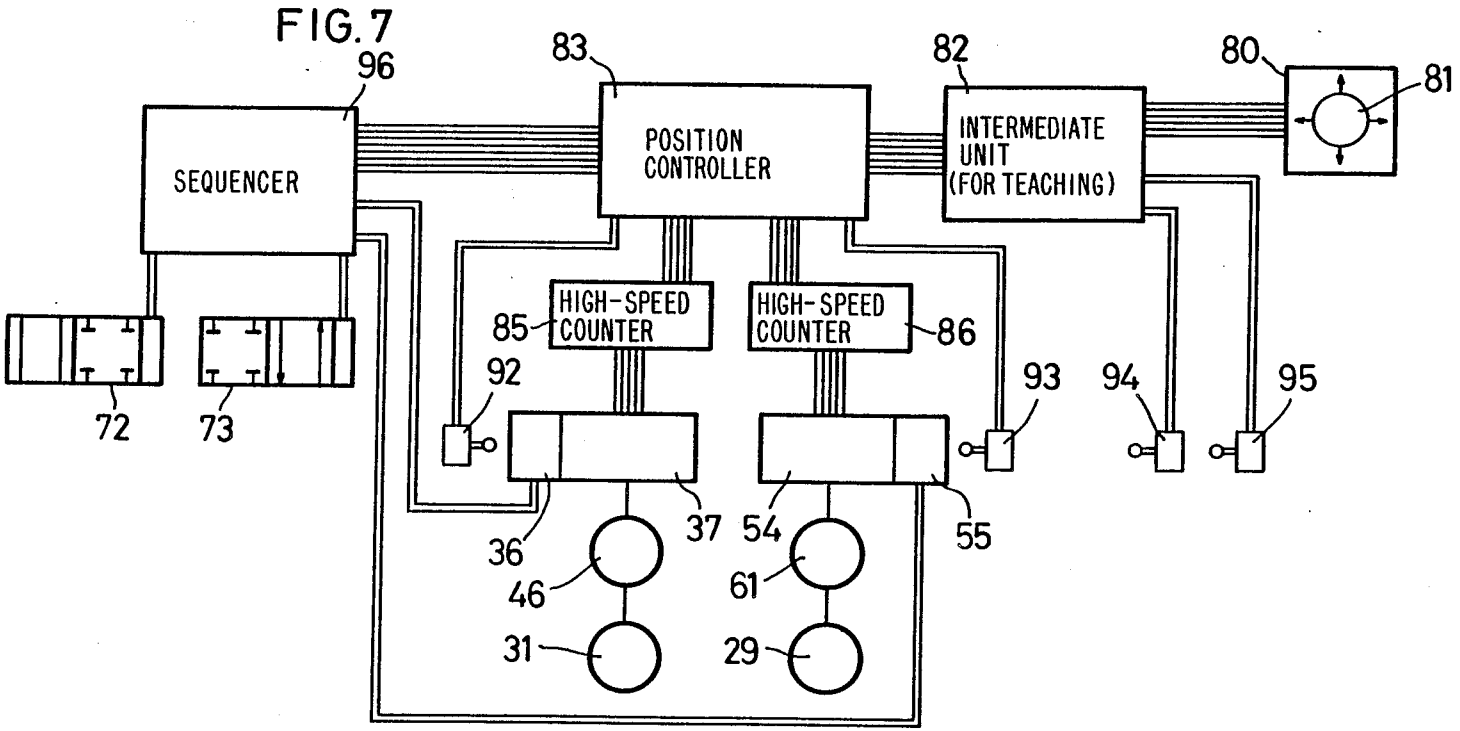
FIG. 7 is a control system diagram of the same.

In the electric circuit diagram in FIG. 7, numeral 80 designates a control device for teaching having a handle 81. By moving the handle 81 in one of the four cross directions, a corresponding circuit will be closed to apply a predetermined control signal to a position controller 83 in the form of a microcomputer through an intermediate teaching unit 82. The output of the controller 83 is applied through high-speed counters 85 and 86 to the servo motors 37 and 54, respectively, to drive them.

Figure 8:
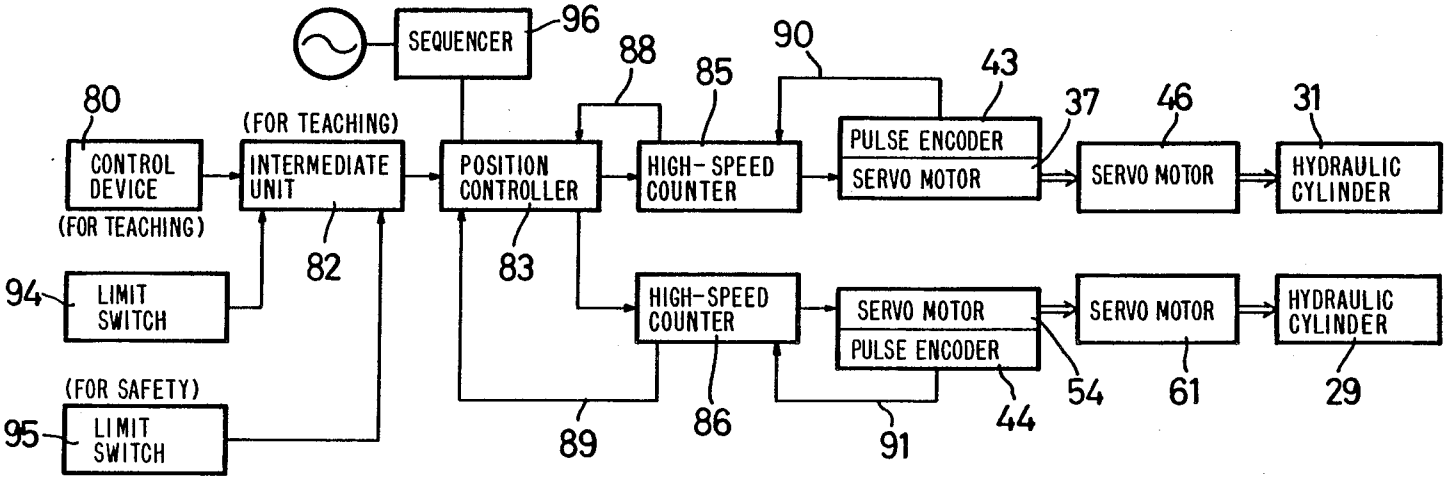
FIG. 8 is a block diagram of the teaching system of the same.
Figure 9:
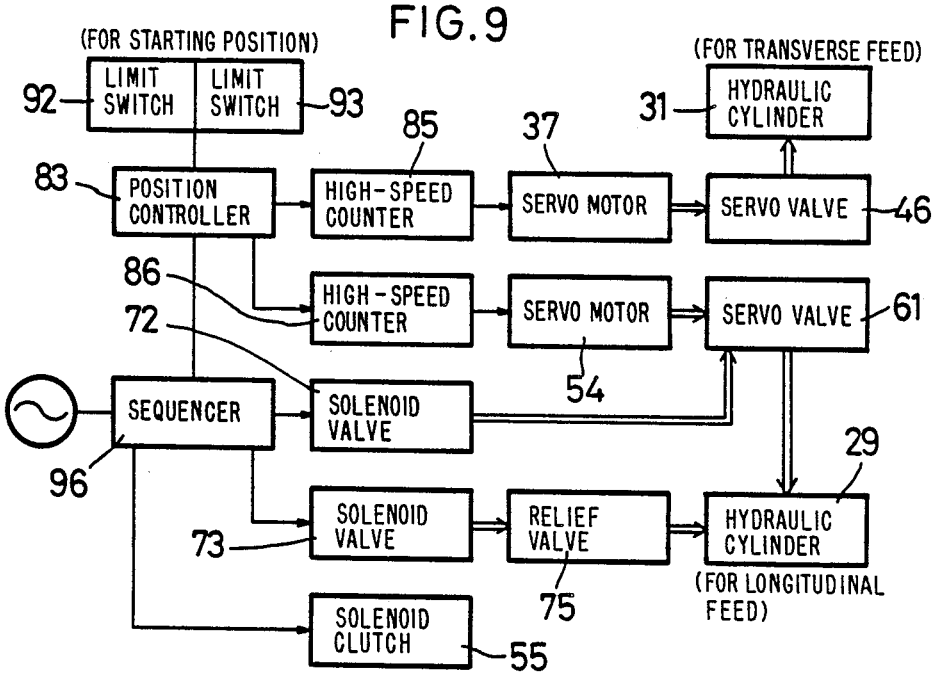
FIG. 9 is a block diagram of the output system of the same.
Figure 10:
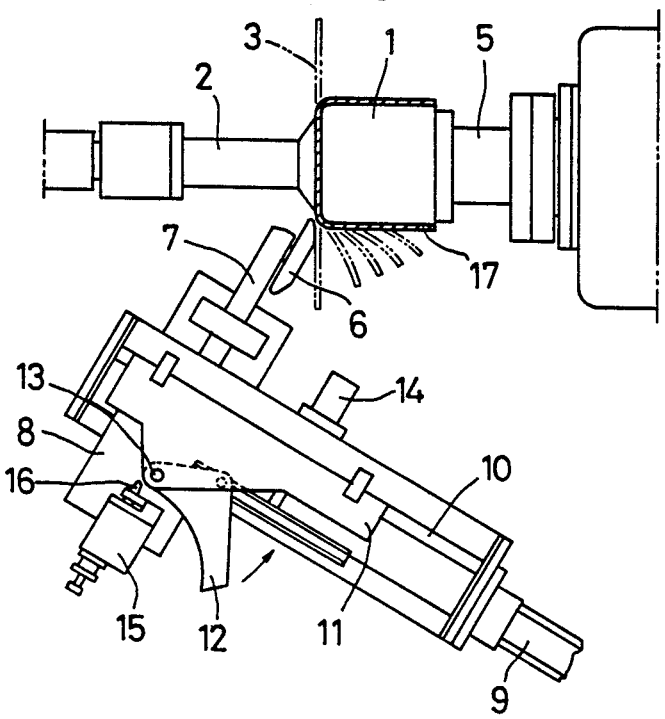
FIG. 10 is a plan view of a prior art spinning machine.

Further, as shown in FIG. 8, feedback circuits 88, 89, 90 and 91 are provided to extend from the high-speed counters 85 and 86 and the pulse encoder 43 and 44, respectively.

Other parts numbered in FIG. 7 are limit switches 92 and 93 for determining the starting points of the roller carriage 24 and the transverse feed carriage 28, respectively, limit switches 94 and 95 for ensuring the safety of teaching control, and a sequencer 96.

Next, the operation of the preferred embodiment will be described. The material 23 is set on the machine as shown in FIG. 1 and turned together with the spindle 25. The control handle 81 of the control device 80 is operated to transmit control signals through the intermediate unit 82, position controller 83, high-speed counters 85 and 86 to the servo motors 37 and 54 and thus to drive them.

By actuating the servo motor 37, the pinion gear 38 connected thereto through the electromagnetic clutch 36 will rotate, thus moving the rack gear 41.

As the rack gear 41 moves, the mobile rail 40 and the coupling member 49 fixed to the rack gear 41 will move together with it. As the coupling member 49 moves, the lever 48 will tilt, thus moving the working piece 51 of the servo valve 46. This will cause the switching of hydraulic circuits leading to the hydraulic cylinder 31.

Thus the hydraulic cylinder 31 will be actuated to move the transverse feed carriage 28 in the direction of arrow a of FIG. 1. By operating the handle 81, the servo motor 54 will be rotated, too. This will in turn rotate the pinion gear 56 coupled thereto through the electromagnetic clutch 55, moving the rack gear 59 and actuating the hydraulic cylinder 29 by the servo valve 61 so as to move the roller carriage 24 in the direction of arrow b. Thus the material 23 will be formed by the forming roller 26 into a shape as shown by chain line v of FIG. 1. The handle 81 is then brought back to its neutral position to allow the forming roller 26 to return to its starting point.

By repeatedly moving the handle between its neutral position and operative position, the material 23 will be gradually formed into a desired shape as shown by chain lines w, x and y.

The above-described operation is carried out with the solenoid valve 72 open and the solenoid valve 73 closed. In the finishing step, the solenoid valve 72 is closed and the solenoid valve 73 is opened so as to switch to the hydraulic circuit 74 for a finishing operation including the relief valve 75. The cylinder 29 will now be driven under a restricted hydraulic pressure, due to the action of the relief valve 75, to press the material 23 with the forming roller 26 against the mold 1. Thus a product shown by solid lines in FIG. 1 is formed.

The control signals produced by operating the control handle 81 and applied to the pulse encoders 43 and 44 are also transmitted as numerical data through the feedback circuits 90 and 91, the high-speed counters 85 and 86 and the feedback circuits 88 and 89 back to the position controller 83 and stored therein, such numerical data indicating every predetermined position of the forming roller with respect to its starting point.

When the teaching is complete and the roller carriage 24 and the transverse feed carriage 28 are brought back to their starting points, the spindle 25 will be stopped and the product 97 be removed from the mold 21. Then another material 23 is set and the machine is started for automatic operation.

In the automatic operation, the position controller 83 and the sequencer 96 transmit position information and information on the operational sequence, respectively, to the servo motors 37 and 54 through the high-speed counters 85 and 86. Thus the servo valves 46 and 61 will operate in the same manner as in the teaching step to move the forming roller 26 with the hydraulic cylinders 31 and 29 in the same manner as in the teaching step.

In this state, the sequencer 96 is producing a signal to open the solenoid valve 72 and close the solenoid valve 73. Thus the forming roller 26 can be controlled by the high-speed counters 85 and 86 so as to be movable at a high speed. This will permit speed-up of the rotation of the spindle 25 and thus the forming step.

After forming the material roughly, the sequence 96 will produce a signal to close the solenoid valve 72 and open the solenoid valve 73 to turn off the electromagnetic clutch 55. Thus the material will be given a finishing touch by the forming roller 26. Upon forming the product 97, the moving parts will all return to their starting points.

What is claimed is:

1. A spinning machine comprising:

rotary means for rotating a mold for having a material formed on the mold;

a first roller carriage reciprocable in first, opposite directions;

a second roller carriage supported on said first roller carriage so as to be reciprocable in second opposite directions perpendicular to said first opposite directions;

a hydraulic system for driving said roller carriages, including a first hydraulic cylinder connected to said first roller carriage for reciprocating said first roller carriage and a second hydraulic cylinder connected to said second roller carriage for reciprocating said second roller carriage;

a forming roller fixedly mounted on said second roller carriage so as to be able to be pressed against a material on a mold on said rotary means to shape the material into a predetermined shape;

a first rack extending in said first opposite directions and a second rack extending in said second opposite directions;

a lever for each said rack, said levers each being pivotally connected to both a respective said rack and a respective said roller carriage;

a servo motor for each said rack, each said servo motor having a pinion gear in meshing engagement with its respective said rack;

a servo valve mounted on each said roller carriage, each said servo valve having a movable spring-biased switch means for actuating and deactuating a respective said hydraulic cylinder in response to movement of a respective said lever, said switch means being pressed against its respective said lever;

a position controlling means for controlling the position of said roller carriages and a sequencing means for sequencing position moving operations of said roller carriages connected to said servo motors;

a pulse encoding means for each said servo motor for feeding the angle of rotation of the respective said servo motors to said position controlling means in the form of pulse signals, said position controlling means being connected to said servo motors through each said pulse encoding means;

a manual-control teaching means for feeding driving signals to said servo motors to move said forming roller in a specified pattern of movement;

wherein said driving signals fed by said manual-control teaching means are stored by said position controlling means in the form of position data and by said sequencing means in the form of operational sequence data;

wherein said first and second roller carriages are controlled based upon said position data stored by said position controlling means and operational sequence data stored by said sequencing means; and a relief valve in said hydraulic system for reducing the hydraulic pressure on one of said first and second hydraulic cylinders in a finishing operation.

2. The spinning machine as set forth in claim 1, wherein:

each said rack is slidably mounted relative to its respective said roller carriage.

3. The spinning machine as set forth in claim 1, wherein:

said hydraulic system includes a hydraulic unit having a pump, driving motor and oil tank, a first hydraulic circuit between said hydraulic unit and said first hydraulic cylinder, said first servo valve being disposed in said first hydraulic circuit, and a second hydraulic circuit between said hydraulic unit and said second hydraulic cylinder, said second servo valve being disposed in said second hydraulic circuit.

4. The spinning machine as set forth in claim 1, wherein said hydraulic system further comprises a third hydraulic circuit for a finishing operation, said relief valve being disposed in said third hydraulic circuit.

5. The spinning machine as set forth in claim 4, wherein a first solenoid valve is disposed in said first hydraulic circuit for opening and closing said first hydraulic circuit and a second solenoid valve is disposed in said third hydraulic circuit for opening and closing said third hydraulic circuit, said solenoid valves being controlled by said sequencing means.

* * * * *